United States Patent [19]

Wood

[11] Patent Number: 4,461,137

[45] Date of Patent: Jul. 24, 1984

[54] METHOD OF MAKING AND FILLING A CORRUGATED CARTON

[76] Inventor: Charles E. Wood, 909 Rocky Canyon Rd., Arlington, Tex. 76012

[21] Appl. No.: 383,498

[22] Filed: Jun. 1, 1982

[51] Int. Cl.[3] ..... B65B 43/10

[52] U.S. Cl. ..... 53/456; 53/462; 493/94; 493/102; 493/110; 493/346; 493/463

[58] Field of Search ..... 53/456, 462, 461; 493/89, 94, 102, 110, 463, 62, 61, 60, 346, 381

[56] References Cited

U.S. PATENT DOCUMENTS

| | | | |
|---|---|---|---|
| 1,609,320 | 12/1926 | Smith | 493/463 X |
| 1,845,891 | 2/1932 | Schroeder | 493/62 |
| 2,024,013 | 12/1935 | Sidebotham | 493/463 X |
| 2,618,208 | 11/1952 | Williamson | 493/102 |
| 3,179,023 | 4/1965 | Hoff | 493/463 X |
| 4,294,642 | 10/1981 | Focke et al. | 493/94 X |

FOREIGN PATENT DOCUMENTS

| | | | |
|---|---|---|---|
| 1251413 | 12/1960 | France | 493/89 |

*Primary Examiner*—James F. Coan

*Attorney, Agent, or Firm*—James E. Bradley

[57] ABSTRACT

A corrugated container and the method of forming the container saves paper. The method of forming the container includes gluing backing webs of paper to each side of a corrugated web, resulting in a composite web of three layer thickness. One of the backing layers is wider than the other backing layers, defining single layer strips on each edge of the multiple layer central section. Longitudinal fold lines are placed in the multiple and single layer strips. The composite web is sheared into sheets, with the sheet being folded along the fold lines into a container. The fold lines are placed to position the single layer portions on the upper sidewalls and top of the container, where less strength is required.

6 Claims, 4 Drawing Figures

METHOD OF MAKING AND FILLING A CORRUGATED CARTON

BACKGROUND OF THE INVENTION

This invention relates in general to a method of making a corrugated container having single layer portions and multiple layer portions.

Single ply corrugated paper for containers is formed of two smooth backing layers, with a corrugated layer glued between. In making the material for corrugated containers, a web of paper from a roll is drawn through a set of corrugating rollers. Then, a backing web is drawn from another roll and glued to the corrugated web. The opposite backing layer is drawn from another roll and glued to the other side of the corrugated web. The result is a composite web of uniform thickness, having three layers, the backing layers and the corrugated layer. Fold lines are placed in the web, and the web is sheared into sheets. At the facility where the container is to be used, the sheet is folded along the fold lines to form the container.

There are many different types of containers, some having separate ends, bottoms, and tops formed of other sheets and glued together. Some containers are folded in different configurations than others. While these containers are satisfactory, in many cases the walls do not need as much strength as is provided by conventional single ply corrugated paper, which has three layers. For example, in the case of metal cans, the cans themselves will support the weight of a stack of such boxes. Making the box entirely of three layer corrugated material results in a waste of paper.

One type of container used for cans consists of a corrugated paper bottom with short corrugated paper walls that extend less than the full length of the cans. Plastic wrap is secured over the cans and to the container bottom to prevent the cans from falling from the container. A disadvantage of this system is the great expense required for wrapping machinery to wrap the plastic.

SUMMARY OF THE INVENTION

A corrugated container is provided that has multiple layer portions and portions that have less layers than the others. In forming the material for the container, a plurality of webs of paper are drawn through corrugating and pressure rollers and glued to define a composite web of multiple layer thickness. At least one of the webs that forms part of the composite web has greater width than the other webs. This results in one or more strips that have fewer layers than the other portions of the composite web. Fold lines are placed in the composite web at the desired places to define corners of the container. The web is sheared into sheets and later formed into the container.

In the preferred embodiment, the composite web has a three layer central section, with single layer strips on each edge. Fold lines are placed in the central three layer section and in the single layer strips. The sheet is folded along these fold lines to form a container that has a three layer bottom. The three layer bottom also extends part way up the sides. The single layer strips form the rest of the sidewalls, with the single layer strips joining at the top to seal the container.

DESCRIPTION OF THE PREFERRED EMBODIMENT

Figure 1:
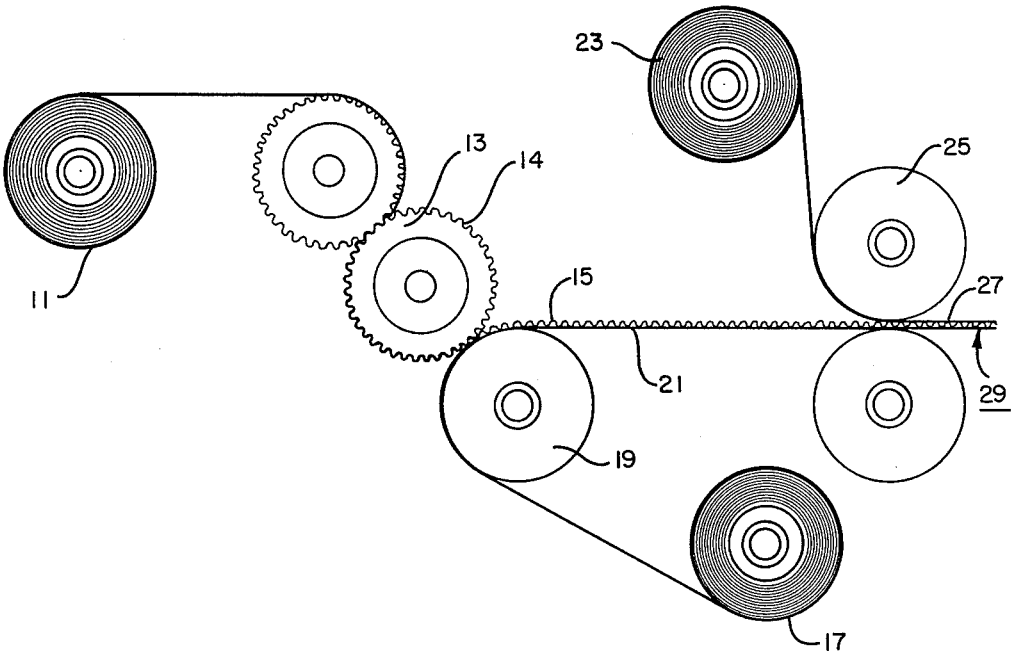
FIG. 1 is a schematic view illustrating how the corrugated paper for the container of this invention is formed.

Referring to FIG. 1, the process of making the material for the container of this invention includes a roll 11 of heavy paper of a type used in forming corrugated paper. Roll 11 is drawn through two corrugating rollers 13. The corrugating rollers 13 contain splines 14 that intermesh. Splines 14 place laterally extending grooves or corrugations in the paper from roll 11, resulting in a corrugated web 15.

A second roll 17 of paper is drawn over a pressure roller 19 that is closely spaced to the last corrugating roller 13. Glue is applied in a conventional manner by rollers (not shown) to one side of the paper from roll 17. Heat, and the pressure from pressure roller 19 assist in gluing the paper from roll 17 to one side of the corrugated web 15, resulting in a backing web 21.

A third roll 23 of paper is drawn past a pair of pressure rollers 25 that are closely spaced to each other. Glue is applied to one side of the paper from roll 23 in a conventional manner with a roller (not shown). Heat and pressure from the rollers 25 assist in gluing the paper from roll 23 to the side of corrugated web 15 opposite backing web 21. This results in a backing web 27. The composite web 29 thus has three layers, which include backing webs 21 and 27 glued to the intermediate or corrugated web 15.

Figure 2:
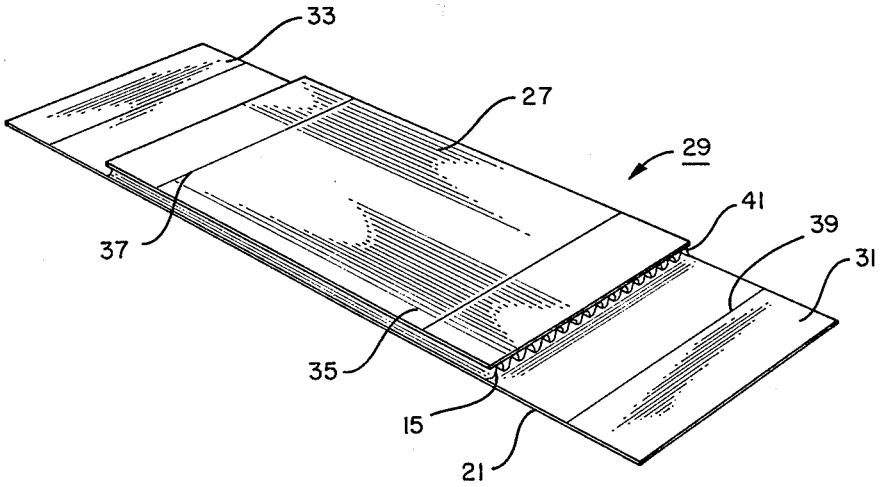
FIG. 2 is a perspective view of a portion of the resulting composite web from FIG. 1.

Referring to FIG. 2, the width of the paper on one of the rolls 17 or 23 is greater than the width of the paper from the other rolls. In the preferred embodiment, the width of the paper from roll 17 is greater than the width of the paper from rolls 11 and 23, resulting in backing web 21 being wider than the backing web 27 and the corrugated web 15. The composite web 29 thus has a central section or portion 35 of three layer thickness, with two strips or portions 31 and 33 of single layer thickness on each edge of the central section 35.

Conventional machinery for placing a fold line places longitudinal fold lines in web 29 parallel with the edges of web 29. As shown in FIG. 2, these fold lines include two fold lines 37 parallel to each other and spaced-apart in the central three layer section 35. Fold lines 37 are located near the edges 41 of the three layer section 35. Fold lines in the composite web 29 also include a fold line 39 placed in the single layer strips 31 and 33. Fold lines 37 and 39 are parallel with each other. Subsequent to placing the fold lines 37 and 39, the composite web 29 is sheared perpendicular to the fold lines to provide a sheet for folding into a container.

Figure 4:
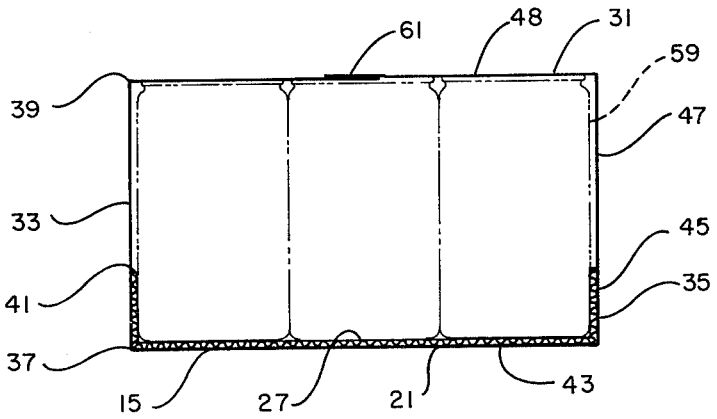
FIG. 4 is a vertical sectional view of an assembled container of this invention.

As shown in FIG. 4, folding the sheet along the fold lines 37 at right angles provides bottom corners and results in a bottom 43 of a container and lower sidewall portions 45. Folding the fold lines 39 at right angles provides top corners, and results in upper sidewall portions 47 and two top portions 48.

Figure 3:
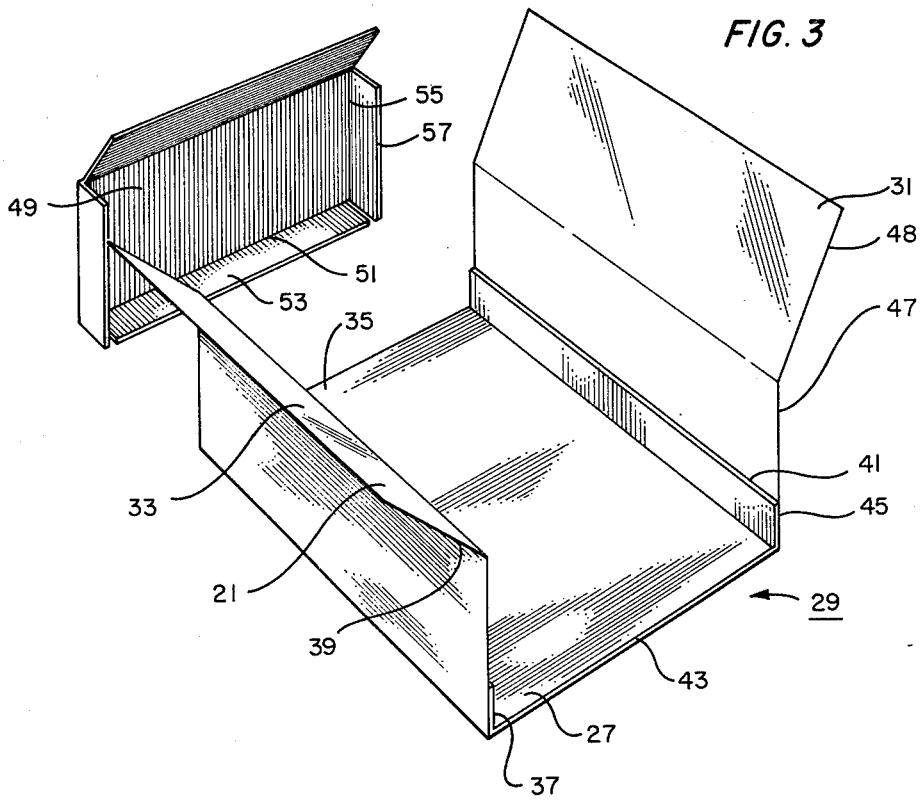
FIG. 3 is a perspective, exploded view of the container of this invention being folded into position.

One of the end pieces 49 for the container of the preferred embodiment is shown in FIG. 3. The opposite end piece is identical. End piece 49 is a three layer section of corrugated paper having backing layers and an intermediate corrugated layer. End piece 49 is preferably formed separately and at a different time than the composite web 29. End piece 49 is a single sheet having transverse fold lines 51 spaced-apart to define upper and lower tabs 53. Longitudinal fold lines 55 are spaced-apart from each other to define two side tabs 57. The tabs 53 and 57 have glue applied to them to be glued to the ends of the three layer section 35 and single layer sections 31 and 33.

The resulting container, as shown in FIG. 4, is particularly suited for carrying metal cans 55. Cans 55 will rest on the bottom 43 and will be of greater height than the lower sidewall portions 45. Bottom 43 and the lower sidewall portions 45 will have three layers of paper. The upper sidewall portions 47 and the top portions 48 comprise a single layer. The top portions 48 overlap at 61 and are glued together to seal the container.

The invention has significant advantages. The resulting container has a lower portion of multiple layered material for supporting the goods within, while the sides and top of the container are of single layer material, for retaining the goods. Forming the container by using one roll of greater width than the other rolls avoids the need for expensive machinery for wrapping plastic, as in the prior art. The container is lighter in weight and uses less paper than conventional corrugated containers.

While the invention has been shown in only one of its forms, it should be apparent to those skilled in the art that it is not so limited but is susceptible to various changes without departing from the scope of the invention.

I claim:

1. A method of forming a sheet of material for a corrugated container, comprising:

drawing a plurality of webs of paper through corrugating and pressure rollers and gluing the webs together to define a composite web having a corrugated layer located between two backing layers;

one of the backing layers being of greater width than the other layers, defining at least one single layer strip and a three layered strip;

making fold lines in the composite web in placed to define corners of the container, with the fold lines placed to position the three layered strip as the bottom of the container and the single layer strip as the top of the container; and shearing the composite web transversely into the sheet.

2. A method of constructing and filling a corrugated container, comprising in combination:

drawing a web of paper through corrugating rollers to define a corrugating web;

gluing backing webs of paper to each side of the corrugated web to define a composite web, one of the backing webs being of greater width than the other backing web and the corrugated web, resulting in a single layer portion and a three layered portion;

making fold lines in the composite web in places to define corners of the container, with the fold lines placed to position the three layered portion as the bottom of the container and the single layer portion as the top of the container;

shearing the composite web transversely into the sheet;

folding the sheet along the fold lines to define the container;

filling the container with goods; then securing the single layer portion over the top of the goods.

3. The method according to claim 2 wherein the single layer portion also forms part of the sidewalls of the container.

4. A method of constructing a corrugated container, comprising:

drawing a web of paper through corrugating rollers to define a corrugated web;

drawing two backing webs of paper and gluing one of the backing webs to each side of the corrugated web to define a three layered strip, one of the backing webs being of greater width than the other backing web and the corrugated web and extending laterally outward from each edge of the three layered strip to define two single layer strips;

making two spaced-apart longitudinal fold lines in the three layered strip to define bottom side corners of the container, with the three layered strip forming the bottom and a lower part of each sidewall of the container;

making a longitudinal fold line in each single layer strip to define top side corners of the container, each single layer strip forming an upper part of each of the sidewalls and part of the top of the container;

shearing the webs transversely to provide a sheet for folding into bottom and sides of a container; and providing end pieces, folding the sheet along the fold lines, and securing the end pieces to the folded sheet to form the container.

5. The method according to claim 4 wherein the end pieces are formed separately from three layered corrugated paper and glued to the bottom and each end of the folded sheet.

6. The method according to claim 4 wherein the edges of each single layer strip overlap, the method further comprising:

gluing the single layer strips together after the container is filled to close the top.

* * * * *